US007413485B2

(12) United States Patent
Lappoehn

(10) Patent No.: US 7,413,485 B2
(45) Date of Patent: Aug. 19, 2008

(54) PLUG-IN CONNECTOR WITH SECONDARY LOCKING DEVICE

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 25 days.

(21) Appl. No.: 11/548,070

(22) Filed: Oct. 10, 2006

(65) Prior Publication Data

US 2008/0003891 A1 Jan. 3, 2008

(30) Foreign Application Priority Data

Jun. 30, 2006 (DE) ..... 10 2006 030 784

(51) Int. Cl.
*H01R 13/514* (2006.01)

(52) U.S. Cl. ..... 439/752; 439/357; 439/595

(58) Field of Classification Search ..... 439/752, 439/595, 357

See application file for complete search history.

(56) References Cited

U.S. PATENT DOCUMENTS

| | | | | |
|---|---|---|---|---|
| 5,947,775 | A | 9/1999 | Yamamoto et al. | |
| 6,488,547 | B2 * | 12/2002 | Tanaka | 439/752 |
| 6,604,966 | B1 * | 8/2003 | Hayes et al. | 439/752 |
| 6,902,443 | B2 * | 6/2005 | Hara et al. | 439/752 |
| 7,029,286 | B2 * | 4/2006 | Hall et al. | 439/63 |
| 7,261,603 | B2 * | 8/2007 | Takahashi et al. | 439/752 |

FOREIGN PATENT DOCUMENTS

| | | | |
|---|---|---|---|
| DE | 29517133 | U1 | 2/1997 |
| DE | 19961591 | A1 | 6/2001 |
| DE | 10015842 | C1 | 2/2002 |
| DE | 20106749 | U1 | 8/2002 |
| DE | 20111964 | U1 | 11/2002 |
| DE | 102005024336 | A1 | 12/2005 |
| EP | 176670 | A1 | 4/1986 |
| EP | 1 176 670 | | 1/2002 |
| FR | 2846473 | A1 | 4/2004 |

* cited by examiner

*Primary Examiner*—Truc T Nguyen
(74) *Attorney, Agent, or Firm*—Collard & Roe, P.C.

(57) ABSTRACT

The invention relates to a plug-in connector with a secondary locking device comprising at least one contact element arranged in a plug-in connector base element. At least one secondary locking recess is provided in the contact element, which extends transversely to the plug-in direction and which is engaged by a locking cam of a secondary locking element in the locking position of the secondary locking element. The plug-in connector according to the invention permits high extraction forces to be achieved and is especially well suited for use in high-current plug-in connection devices.

8 Claims, 5 Drawing Sheets

PLUG-IN CONNECTOR WITH SECONDARY LOCKING DEVICE

DESCRIPTION OF THE PRIOR ART

The present invention relates to a plug-in connector with a secondary locking device according to the preamble of the independent claim.

DE 10 2005 024 336 A1 describes an electric plug-in connector which provides increased extraction force or pulling-out force for a line connected to a plug-in connector, which is obtained by a secondary locking element. The secondary locking element is pushed into the locking position, transversely to the plug-in direction, after assembly of the contact elements in a base element of a plug-in connector. In its locking position, the secondary locking element engages behind a locking shoulder formed on each of the contact elements.

Utility Patent DE 201 11 964 U1 describes a secondary locking device for a connector of a cable harness that comprises different types of contacts. The secondary locking element embraces the contact elements in the assembled condition.

DE 100 15 842 C1 describes a plug-in connector with a secondary locking device and a strain relief device where a contact element is retained by a spring in a primary locking recess in the plug-in connector base element in the assembled condition of the contact element. After assembly of the contact elements in the plug-in connector base element, a secondary locking element is pushed onto the plug-in connector base element, transversely to the plug-in direction, so that it comes to embrace the plug-in connector base element on both sides. Locking cams, formed integrally on both sides of the secondary locking element, extend over the full width of the secondary locking element. In the mounted condition of the secondary locking element, the two locking cams each embrace a rear end of the contact elements, relative to the plug-in connection, thereby securing the contact elements from being pulled off the plug-in connector base element unintentionally.

Utility Patent DE 201 06 749 U1 describes a plug-in connector with a secondary locking device, which is especially well suited for establishing a connection with a lambda sensor. The secondary locking element is configured as a cover element that embraces a base element of the plug-in connector at least in part in the assembled condition. The cover element contains a fixing element for fixing at least one contact element fitted in the plug-in connector base element. The fixing element has a W-shaped cross-section, the two legs embracing the electric contact axially in the assembled condition.

Utility Patent No. DE 295 17 133 U1 describes a four-pole electric plug-in connector comprising a secondary locking element which, after assembly of the contact element in a plug-in connector base element, is initially displaced in the plug-in direction. The secondary locking element hits upon a tapered surface which superposes to the displacement in the plug-in direction a motion transverse to the plug-in direction, which latter continues until the secondary locking element embraces the forward and rear ends of an enlarged portion formed in the central area of the contact element.

DE 199 61 591 A1 describes a multi-pole electric plug-in connection device which likewise comprises a secondary locking device in addition to a primary locking device. Secondary locking occurs during assembly of the plug-in connector by displacement of the secondary locking element transversely to the plug-in direction. The secondary locking element comprises a plurality of locking cams each of which engages behind a projection formed integrally on the contact elements, in the locked condition.

Now, it is the object of the present invention to provide a plug-in connector with a secondary locking device that provides high extraction force.

This object is achieved by the features defined in the independent claim.

DISCLOSURE OF THE INVENTION

The plug-in connector according to the invention with a secondary locking device comprises at least one contact element arranged in a plug-in connector base element. In the contact element, there is provided at least one secondary locking recess, extending transversely to the plug-in direction, which is engaged by a locking cam of a secondary locking element in the locking position of the secondary locking element.

Due to the at least one recess in the contact element, which is engaged by the locking cam of the secondary locking element, a considerably higher extraction force or tearing-out force is achieved that counteracts any risk of the contact element being pulled off or torn out of the plug-in connector base element unintentionally.

The plug-in connector according to the invention meets increased safety demands of the kind placed on plug-in connectors in the vehicle industry, for example.

The plug-in connector according to the invention is especially well suited for the production of high-current plug-and-socket connections that have to meet increased safety demands with respect to extraction forces.

The high extraction force is achieved during production of the plug-in connector at practically no additional expense compared with the solutions known from the prior art. This results in considerable cost savings especially in series production of the plug-in connector according to the invention.

Advantageous further developments and configurations of the plug-in connector according to the invention with a secondary locking device are defined in the dependent claims.

The extraction force can be adapted to the predetermined extraction force requirements by varying the number of recesses which are engaged by locking cams on the secondary locking element in the locking position of the secondary locking element. Extraction forces of 100 N, for example, can be achieved in a simple way without any additional means.

According to one embodiment, a recess of the secondary locking element is provided in the plug-in connector base element for receiving the secondary locking element in the locking position. This feature makes the secondary locking element an integral part of the plug-in connector in the locked position.

According to one embodiment, the secondary locking element has at least one fixing clamp that embraces a fixing projection provided on the plug-in connector main body in the locking position of the secondary locking element. The fixing clamp may also be described as a snap-in hook. This feature fixes the secondary locking element in the locking position. Preferably, two fixing clamps are provided each of which embraces a fixing projection in the locking position of the secondary locking element. The secondary locking element is thereby firmly retained especially on multi-pole plug-in connectors of greater width.

An especially advantageous embodiment provides that the secondary locking element is equipped with an encoding surface on its forward end, which prevents the plug-in connector from being plugged in when the secondary locking element is outside its locking position. This feature increases the safety of the connection achievable with the aid of the plug-in connector according to the invention. Introducing the plug-in connector according to the invention into the second plug-in connector corresponding to the plug-in connector according to the invention is possible only with the secondary locking element located in the locking position.

One embodiment provides that at least one encoding rib extends in the plug-in direction in the forward area of the secondary locking element. The encoding rib prevents the connection from being made incorrectly when the secondary locking element occupies its locking position.

According to one embodiment, at least one transverse guide element, intended to guide the secondary locking element transversely to the plug-in direction, is provided on at least one side of the secondary locking element. With the aid of that feature, a guide is realized for the secondary locking element when the secondary locking element is displaced transversely to the plug-in direction.

Correspondingly, at least one recess for the transverse guide is provided on at least one side of the plug-in connector main body, for receiving the transverse guide element. Preferably, at least two transverse guide elements and two recesses for the guide elements are provided.

Conveniently, transverse guide elements and recesses for the transverse guides are provided on both sides of the plug-in connector, especially in the case of plug-in connectors of greater width.

Another embodiment provides that the plug-in connector base element contains at least one retaining rib, that the locking cam of the secondary locking element has a two-part design and is provided with claws on its forward end that are pre-locked on the retaining rib. This feature ensures that the secondary locking element will be connected with the plug-in connector base element loosely but undetachably outside its locking position. This facilitates handling of the plug-in connector according to the invention before the secondary locking element is definitely mounted.

According to a further development of the plug-in connector according to the invention, a primary locking device is provided, which contains a snap-in spring for spring-actuated engagement into a primary locking recess formed in the plug-in connector main body. That embodiment of the primary locking device has proven its value already in the case of the plug-in connectors known from the prior art.

Certain embodiments of the invention are illustrated in the drawing and will be described in more detail hereafter.

Figure 1:
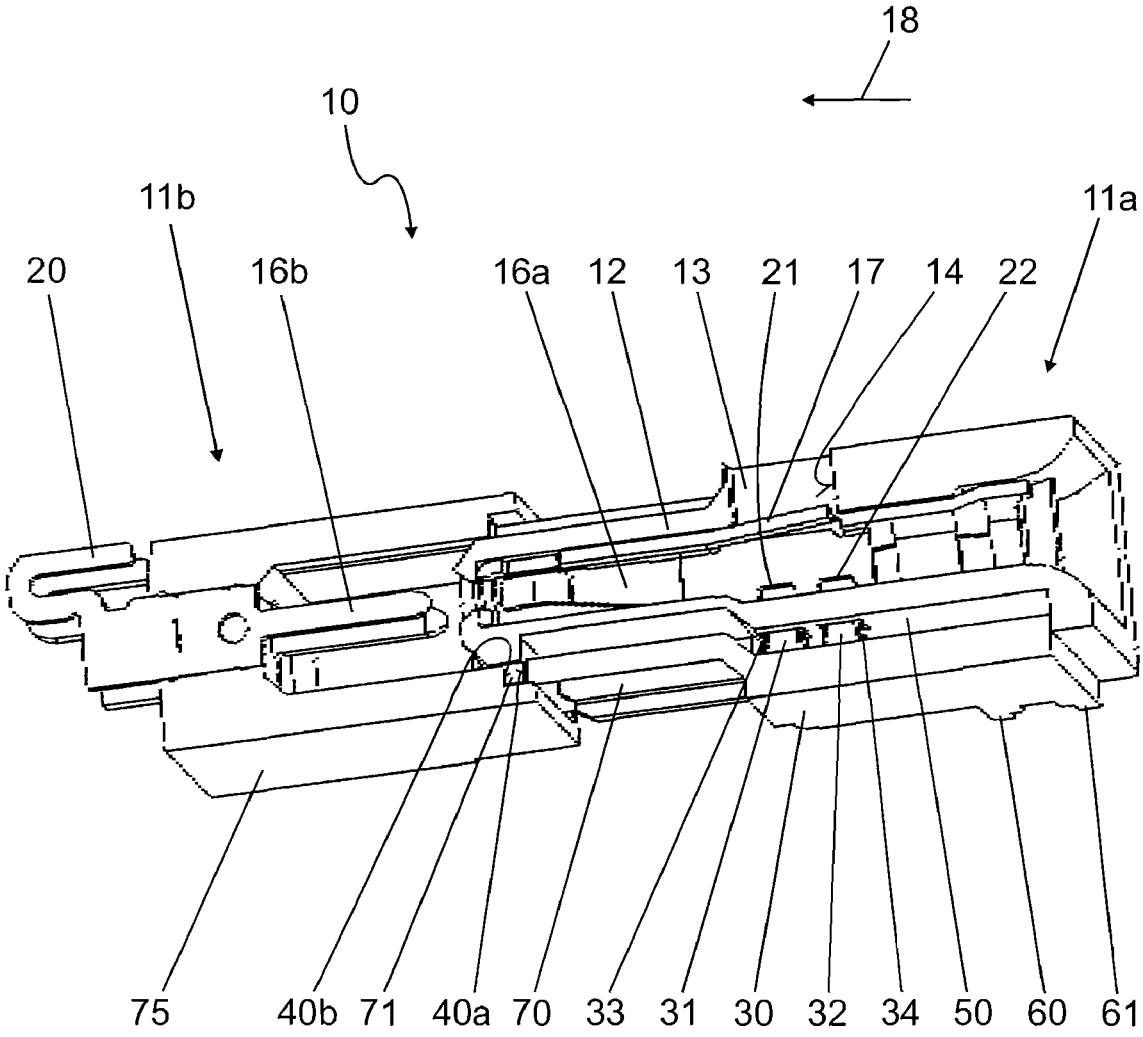
FIG. 1 shows a perspective cross-section of a plug-in connection device with a plug-in connector according to the invention.

FIG. 1 shows a perspective cross-section through a plug-in connection device 10 illustrating a plug-in connector 11*a* according to the invention and a second plug-in connector 11*b* corresponding to the plug-in connector 11*a*, in the unplugged condition.

The plug-in connector 11*a* comprises a plug-in connector base element 12 in which, preferably, a primary locking recess 13 is provided that provides an abutment 14 for the primary locking element. The primary locking recess 13 may be formed, for example, already during injection-molding of the plug-in connector base element 12. According to another solution, the recess 13 may be produced by milling.

In the illustration of FIG. 1, the contact elements are arranged already in the plug-in connector base element 12, the cross-sectional view illustrating a part of a contact element 16*a*. The contact element 16*a* is connected with a snap-in spring 17 which, in the fitted condition of the contact element 16*a*, springs into the primary locking recess 13 and supports the contact element 16*a* on the primary locking abutment 14 from being pulled out against the plug-in direction 18.

In the illustrated embodiment, the contact element 16*a* is configured, for example, as a multiple-contact strip that interacts with a corresponding contact element 16*b*, configured as a multipoint plug, arranged in the corresponding second plug-in connector 11*b*. The corresponding contact element 16*b* is provided on its rear end with a wire terminating tab by means of which the corresponding contact element 16*b* can be soldered to a circuit board not shown in detail.

The contact element 16*a* comprises at least one secondary locking recess 21, 22 formed in the contact element 16*a* transversely to the plug-in direction 18. In the illustrated embodiment, two such primary locking recesses 21, 22 are shown.

In the embodiment illustrated in FIG. 1, the plug-in connector base element 12 is shown to have a secondary locking element 30, which is already loosely connected to the plug-in connector base element 12. The secondary locking element 30 comprises at least one locking cam 31, 32, the number of such cams corresponding maximally to the number of secondary locking recesses 21, 22 in the contact element 16*a*.

In the illustrated embodiment, the at least one locking cam 31, 32 has a two-part design and each of its forward ends comprises claws, not visible in FIG. 1, which in the pre-locked condition of the secondary locking element 30 illustrated in FIG. 1 embrace at least one retaining rib 33, 34 provided in the plug-in connector base element 12. The number of retaining ribs 33, 34 corresponds to at least the number of the existing locking cams 31, 32. The secondary locking element 30 is thereby loosely connected with the plug-in connector base element 12 and can no longer get lost.

Just as a two-part design of the at least one locking cam 31, 32 may be selected, it is likewise possible to provide for a two-part design of the contact element 16*a* in the area of the at least one secondary locking recess 21, 22, as the forward end of the contact element 16*a* anyway must be given such a two-part design if spring elements are provided.

Viewed in the plug-in direction 18, the secondary locking element 30 is provided with an encoding surface 40 on its forward end. The encoding surface 40 interacts with a corresponding encoding surface 40*b* provided on the corresponding second plug-in connector 11*b*. When the secondary locking element 30 occupies a position outside its locking position, any attempt to plug in the connector will cause the encoding surface 40*a* and the corresponding encoding surface 40*b* to abut each other and to thereby prevent the plugging-in attempt from being continued.

The secondary locking element 30 must be moved from its pre-locked position illustrated in FIG. 1 into its locking position before the plug-in connector 11*a* can be plugged in. Preferably, a secondary locking recess 50 is provided in the plug-in connector base element 12 for receiving the secondary locking element 30 in the locking position. The secondary locking recess 50 may again be formed during injection-molding of the plug-in connector base element 12. According to another solution, the recess 50 of the secondary locking element can be produced by milling in this case as well.

For guiding the secondary locking element 30 when the latter is actuated transversely to the plug-in direction 18, there is preferably provided at least one transverse guide element 60, 61, which is indicated in FIG. 1 only vaguely.

The secondary locking element 30 preferably comprises in its forward portion at least one encoding rib 70 that extends in the plug-in direction 18. The at least one encoding rib 70 prevents any faulty plugging-in when the secondary locking element 30 already occupies its locking position.

Additionally, an encoding element 71 formed integrally on the plug-in connector base element 12 may be provided, if desired, for preventing especially any faulty orientation of the plug-in connector 11*a* relative to the corresponding plug-in connector 11*b*. The encoding element 71 interacts with at least one recess in a corresponding plug-in connector base element 75 of the corresponding second plug-in connector 16*b*, which is not visible in FIG. 1.

Figure 2:
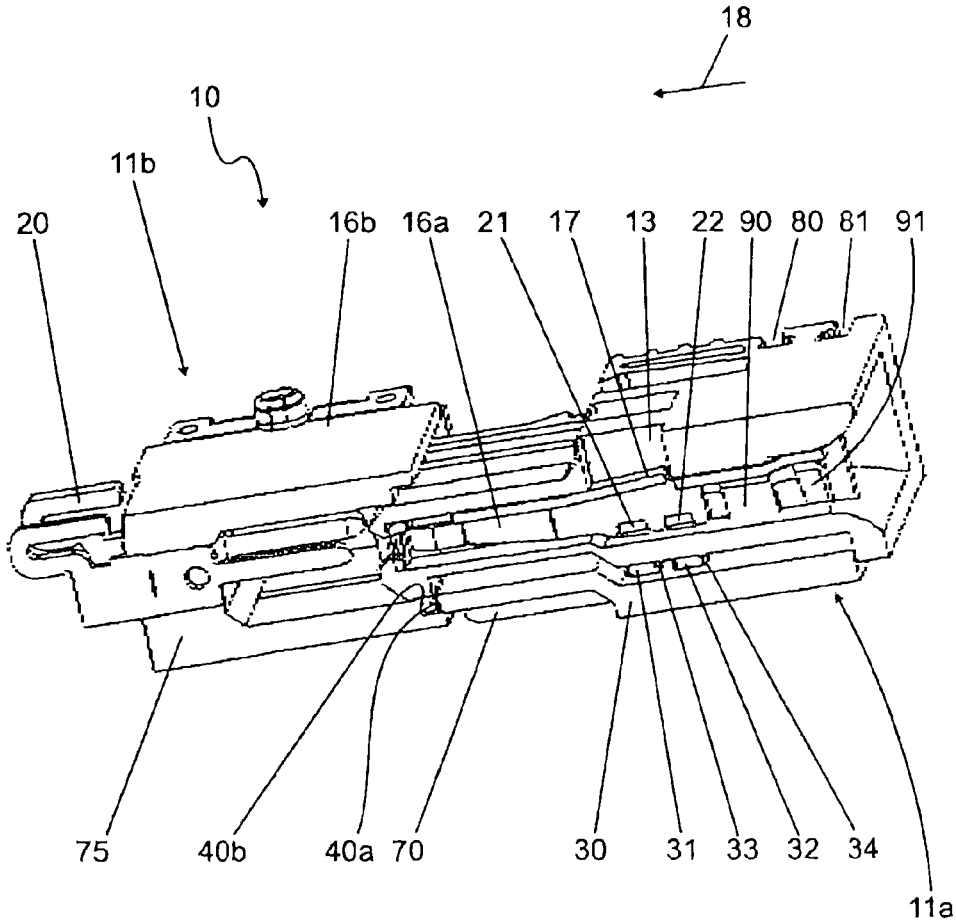
FIG. 2 shows another perspective cross-section through a plug-in connection device with a plug-in connector according to the invention.

FIG. 2 shows a further perspective cross-section through the plug-in connection device 10 where those parts of FIG. 2 which correspond to parts illustrated in FIG. 1 are designated by identical reference numerals.

FIG. 2 shows the secondary locking element 30 likewise in its locked position in the plug-in connector base element 12. FIG. 2 provides a view on the bottom of the plug-in connection device 10. At least one transverse guide recess 80, 81 is formed laterally on the plug-in connector base element 12 for guiding the at least one transverse guide element 60, 61 transversely to the plug-in direction 18.

The contact element 16*a* comprises a wire crimp lug 90 on its rear portion, as well as an insulating crimp lug 91 for fixing a connection line 92 by crimping.

Figure 3:
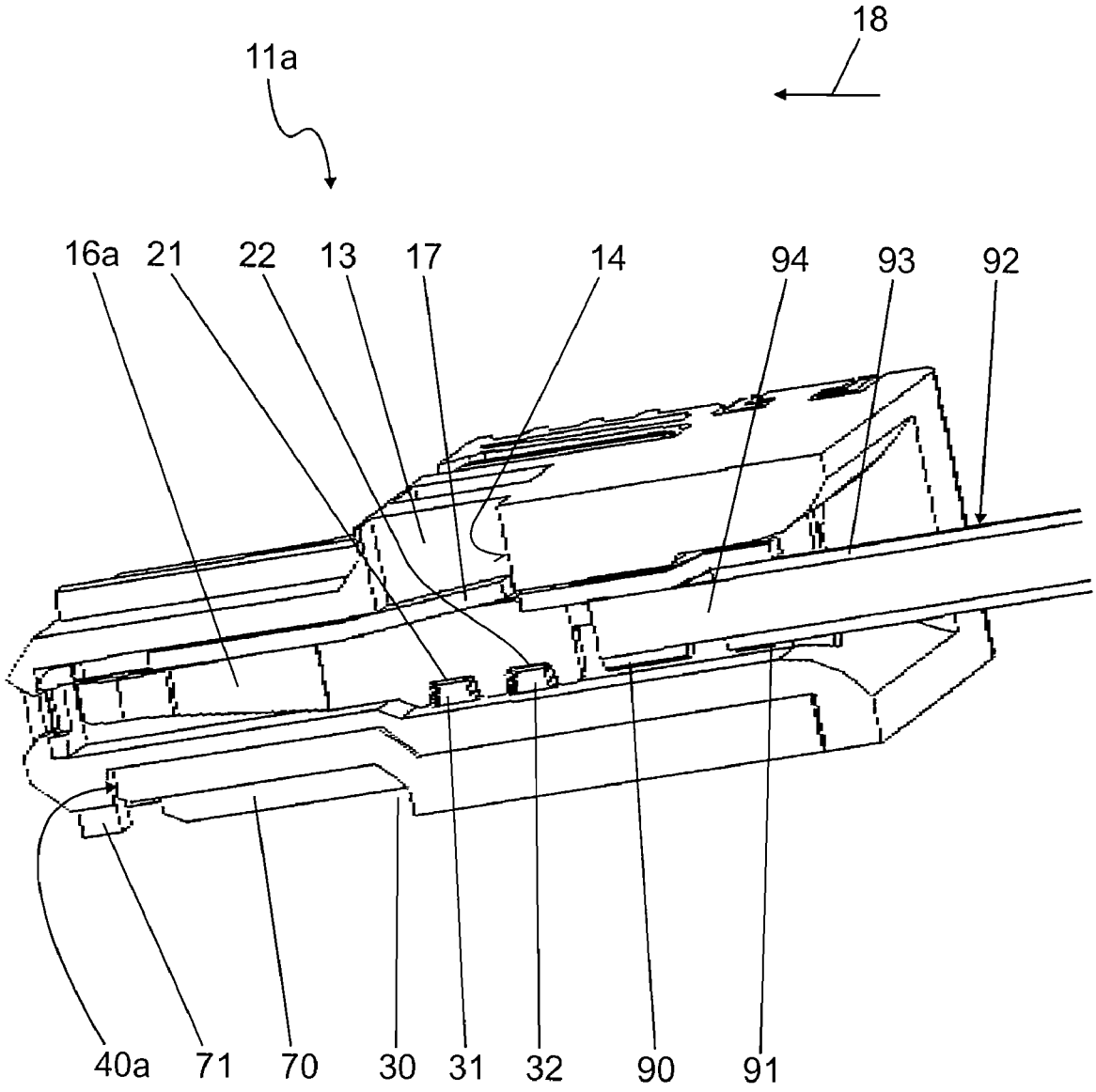
FIG. 3 shows a perspective cross-section through a plug-in connector according to the invention with a fitted connection line.

FIG. 3 shows a perspective cross-section through the plug-in connector 11*a* according to the invention with a fitted connection line 92. Those parts in FIG. 3 which correspond to parts illustrated in the preceding Figures are again designated by identical reference numerals.

The connection line 92 is enclosed by an insulation 93 that ends in the area of the insulating crimp lug 91. At its forward end, the wire 94 of the connection line 92 is stripped in the area of the wire crimp lug 90. FIG. 3 shows the secondary locking element 30 in the locked position where at least one locking cam 30, 31 is positioned in the corresponding secondary locking recess 21, 22.

Figure 4:
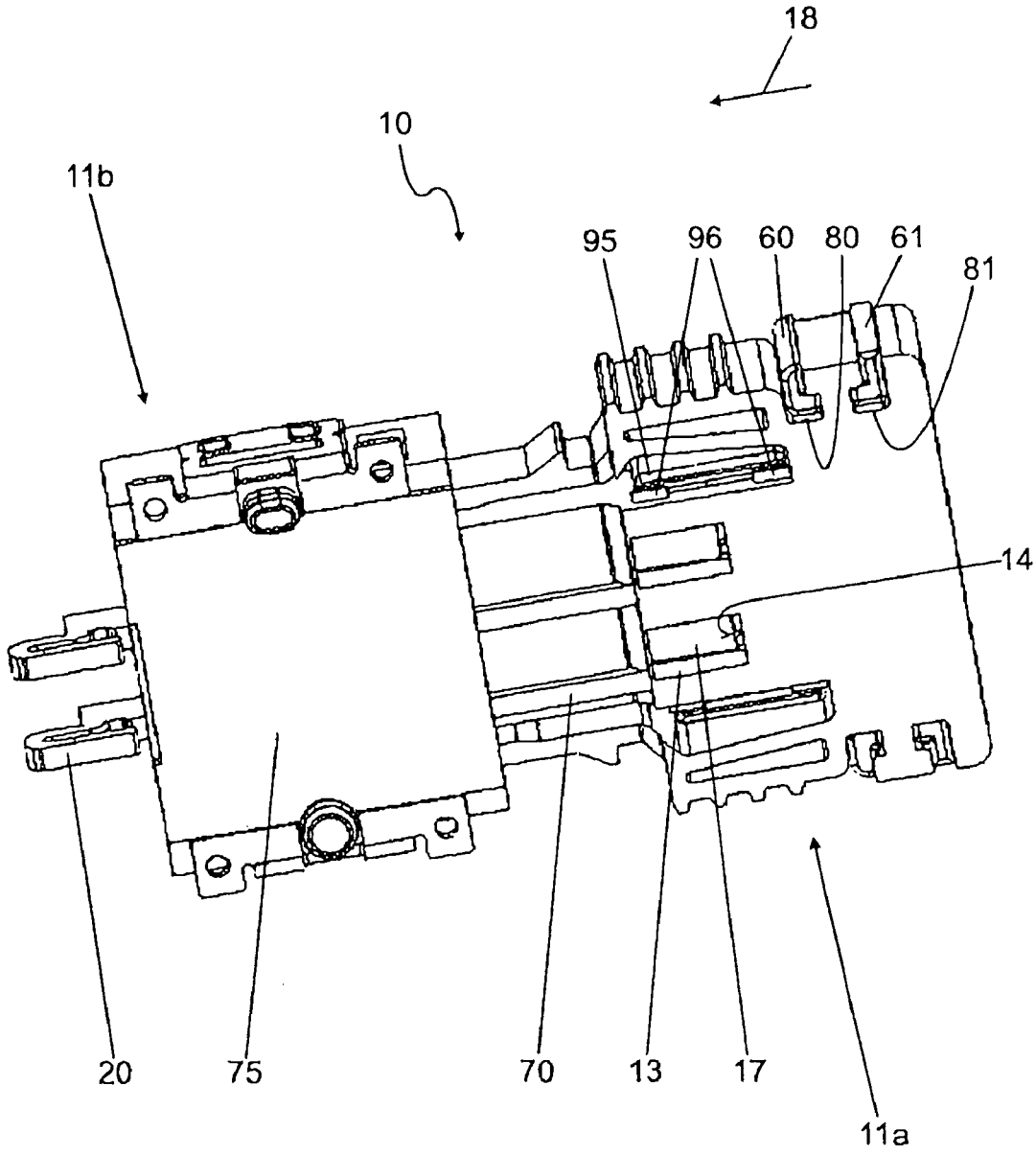
FIG. 4 shows a perspective bottom view of a plug-in connection device with a plug-in connector according to the invention.

FIG. 4 shows a perspective bottom view of the plug-in connection device 10. Here again, those parts of FIG. 4 that correspond to parts illustrated in the preceding Figures, are indicated by identical reference numerals. In FIG. 4, the way in which the at least one transverse guide element 60, 61 is guided in the at least one transverse guide recess 80, 81 can be seen more clearly. Further, the snap-in springs 17 can be seen in their locked position in the primary locking recesses 13 in FIG. 4.

FIG. 4 further shows at least one fixing clamp 95 provided on the secondary locking element 30, which will snap around a fixing projection 96 provided on the plug-in connector base element 12, when the locking position of the secondary locking element 30 is reached, thereby embracing the fixing projection 96 and fixing the secondary locking element 30 on the plug-in connector base element 12.

Figure 5:
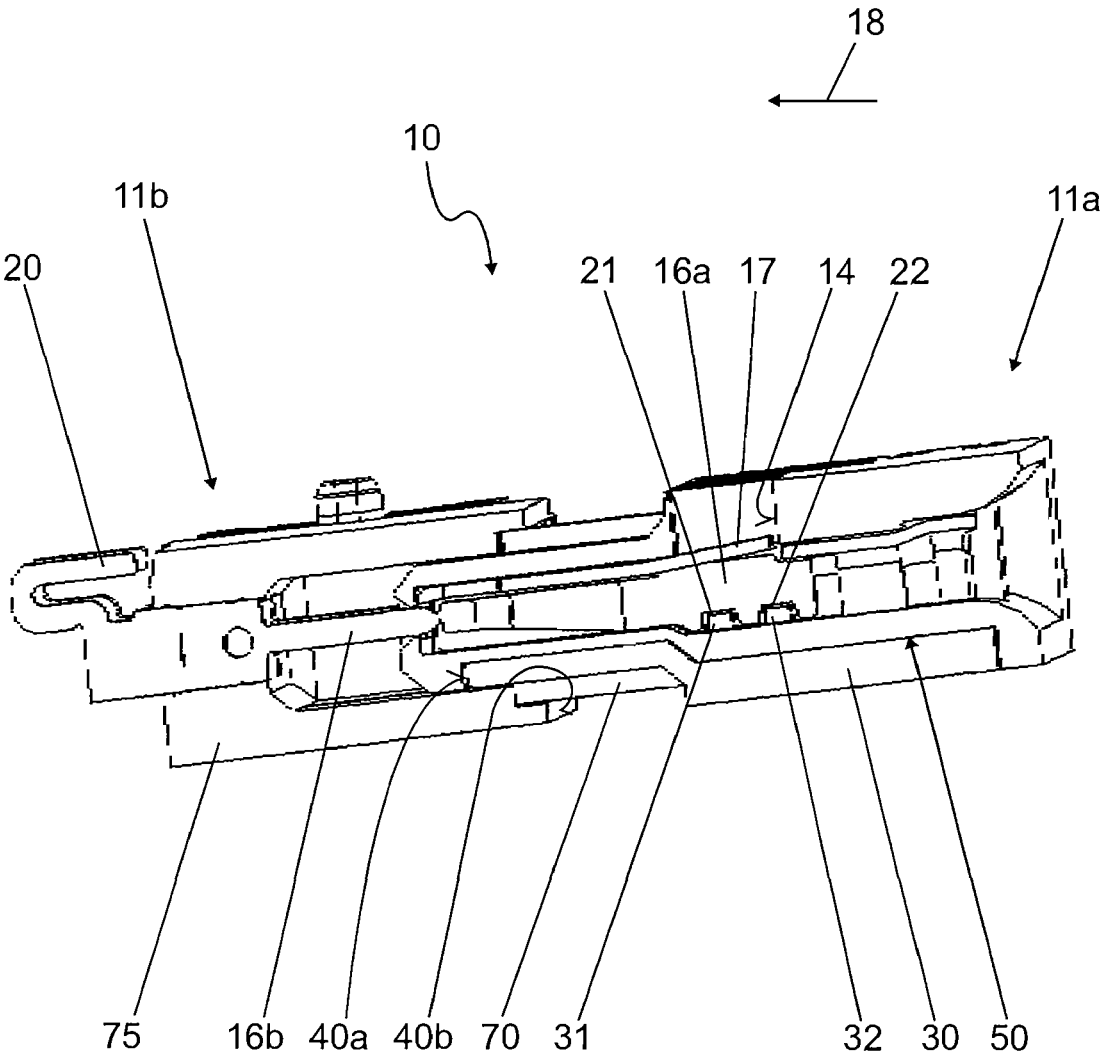
FIG. 5 shows a perspective cross-section through a plug-in connection device with a plug-in connector according to the invention, in plugged condition.

FIG. 5 shows a perspective cross-section through the plug-in connection device 10 in the plugged condition. Those parts of FIG. 5 that correspond to parts shown in the preceding Figures are again designated by identical reference numerals.

FIG. 5 shows the secondary locking element 30 in the locking position where at least one locking cam 31, 32 is positioned in the corresponding secondary locking recess 21. 22. Plugging the plug-in connector 11*a* into the corresponding second plug-in connector 11*b* is possible only in the locking position of the secondary locking element 30 illustrated in FIG. 5.

The invention claimed is:

1. A plug-in connector with a secondary locking device comprising at least one contact element arranged in a plug-in connector base element wherein at least one secondary locking recess is provided which extends transversely to the plug-in direction in the contact element and which is engaged by a locking cam of a secondary locking element in the locking position of the secondary locking element;

wherein the secondary locking element is equipped with an encoding surface on its forward end, which prevents the plug-in connector from being plugged in when the secondary locking element is outside its locking position; and wherein at least one encoding rib extends in the plug-in direction in the forward area of the secondary locking element, which prevents any faulty plugging-in when the secondary locking element already occupies its locking position.

2. The plug-in connector according to claim 1, wherein the number of secondary locking recesses is determined depending on the predetermined extraction force.

3. The plug-in connector according to claim 1, wherein a secondary locking recess is provided in the plug-in connector base for receiving the secondary locking element in the locking position.

4. The plug-in connector according to claim 1, wherein the secondary locking element has at least one fixing clamp that embraces a fixing projection provided on the plug-in connector main body in the locking position of the secondary locking element.

5. The plug-in connector according to claim 1, wherein at least one transverse guide element intended to guide the secondary locking element transversely to the plug-in direction, is provided on at least one side of the secondary locking element.

6. The plug-in connector according to claim 5, wherein at least one transverse guide recess is provided on at least one side of the plug-in connector main body, for receiving the at least one transverse guide element.

7. The plug-in connector according to claim 1, wherein the plug-in connector base element contains at least one retaining rib, wherein the locking cam of the secondary locking element has a two-part design and is provided with claws on its forward end, wherein the claws are pre-locked on the retaining rib whereby the secondary locking element is connected with the plug-in connector base element loosely but undetachably.

8. The plug-in connector according to claim 1, wherein a primary locking device is provided, which comprises a snap-in spring for spring-actuated engagement into a primary locking recess formed in the plug-in connector main body.

* * * * *